US011193378B2

(12) United States Patent
Lee

(10) Patent No.: US 11,193,378 B2
(45) Date of Patent: Dec. 7, 2021

(54) TURBINE AIRFOIL WITH TRAILING EDGE FRAMING FEATURES

(71) Applicant: Siemens Energy Global GmbH & Co. KG, Munich (DE)

(72) Inventor: Ching-Pang Lee, Cincinnati, OH (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 259 days.

(21) Appl. No.: 16/086,226

(22) PCT Filed: Oct. 24, 2016

(86) PCT No.: PCT/US2016/058361

§ 371 (c)(1),
(2) Date: Sep. 18, 2018

(87) PCT Pub. No.: WO2017/164935

PCT Pub. Date: Sep. 28, 2017

(65) Prior Publication Data

US 2020/0291787 A1 Sep. 17, 2020

Related U.S. Application Data

(60) Provisional application No. 62/311,628, filed on Mar. 22, 2016.

(51) Int. Cl.
*F01D 5/18* (2006.01)
*F01D 5/14* (2006.01)

(52) U.S. Cl.
CPC ..... *F01D 5/187* (2013.01); *F01D 5/141* (2013.01); *F05D 2230/21* (2013.01);
(Continued)

(58) Field of Classification Search
CPC ..... F01D 5/186; F01D 5/187; F01D 5/188; F01D 5/189
See application file for complete search history.

(56) References Cited

U.S. PATENT DOCUMENTS 5,752,801 A 5/1998 Kennedy
6,602,047 B1 8/2003 Barreto et al.
(Continued)

FOREIGN PATENT DOCUMENTS

EP 2378073 A1 10/2011
EP 2426317 A1 3/2012
(Continued)

OTHER PUBLICATIONS

PCT International Search Report and Written Opinion dated Aug. 14, 2017 corresponding to PCT Application No. PCT/US2016/058361 filed Oct. 24, 2016.

*Primary Examiner* — David Hamaoui
*Assistant Examiner* — Michael K. Reitz

(57) ABSTRACT

A turbine airfoil (10) includes a trailing edge coolant cavity (41*f*) located in an airfoil interior (11) between a pressure sidewall (14) and a suction sidewall (16). The trailing edge coolant cavity (41*f*) is positioned adjacent to a trailing edge (20) of the turbine airfoil (10) and is in fluid communication with a plurality of coolant exit slots (28) positioned along the trailing edge (20). At least one framing passage (70, 80) is formed at a span-wise end of the trailing edge coolant cavity (41*f*). The airfoil (10) further includes framing features (72A-B, 82A-B) located in the framing passage (70, 80). The framing features are configured as ribs (72A-B, 82A-B) protruding from the pressure sidewall (14) and/or the suction sidewall (16). The ribs (72A-B, 82A-B) extend partially between the pressure sidewall (14) and the suction sidewall (16).

9 Claims, 7 Drawing Sheets

(52) U.S. Cl.
CPC .. *F05D 2240/301* (2013.01); *F05D 2240/303* (2013.01); *F05D 2240/304* (2013.01); *F05D 2240/305* (2013.01); *F05D 2240/306* (2013.01); *F05D 2260/201* (2013.01); *F05D 2260/22141* (2013.01)

(56) References Cited

U.S. PATENT DOCUMENTS

| | | | | |
|---|---|---|---|---|
| 6,974,308 | B2 * | 12/2005 | Halfmann | F01D 5/187 416/97 R |
| 8,262,355 | B2 * | 9/2012 | Kopmels | F01D 5/187 416/96 R |
| 8,506,252 | B1 * | 8/2013 | Liang | F01D 5/187 416/97 R |
| 8,936,067 | B2 * | 1/2015 | Lee | B22C 9/10 164/369 |
| 2008/0050244 | A1 | 2/2008 | Cherolis | |
| 2009/0068022 | A1 | 3/2009 | Liang | |
| 2011/0176930 | A1 | 7/2011 | Ahmad et al. | |
| 2014/0083116 | A1 * | 3/2014 | Crites | F01D 5/187 60/806 |
| 2016/0169002 | A1 * | 6/2016 | Chlus | F02C 7/18 416/1 |
| 2017/0167270 | A1 * | 6/2017 | Itzel | B23K 15/0086 |

FOREIGN PATENT DOCUMENTS

| | | | |
|---|---|---|---|
| EP | 2489835 | A1 | 8/2012 |
| JP | 2011527398 | A | 10/2011 |
| WO | 2015116338 | A1 | 8/2015 |

* cited by examiner

VIEW II-II

VIEW IV-IV

VIEW IX-IX

VIEW X-X

TURBINE AIRFOIL WITH TRAILING EDGE FRAMING FEATURES

BACKGROUND

1. Field

The present invention is directed generally to turbine airfoils, and more particularly to an improved trailing edge cooling feature for a turbine airfoil.

2. Description of the Related Art

In gas turbine engines, compressed air discharged from a compressor section and fuel introduced from a source of fuel are mixed together and burned in a combustion section, creating combustion products defining a high temperature and high pressure working gas. The working gas is directed through a hot gas path in a turbine section of the engine, where the working gas expands to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as airfoils, e.g., stationary vanes and rotating blades within the turbine section, must be cooled with cooling fluid, such as air discharged from a compressor in the compressor section, to prevent overheating of the components. In order to push gas turbine efficiencies even higher, there is a continuing drive to reduce coolant consumption in the turbine. For example, it is known to form turbine blades and vanes of ceramic matrix composite (CMC) materials, which have higher temperature capabilities than conventional superalloys, which makes it possible to reduce consumption of compressor air for cooling purposes.

Effective cooling of turbine airfoils requires delivering the relatively cool air to critical regions such as along the trailing edge of a turbine blade or a stationary vane. The associated cooling apertures may, for example, extend between an upstream, relatively high pressure cavity within the airfoil and one of the exterior surfaces of the turbine blade. Blade cavities typically extend in a radial direction with respect to the rotor and stator of the machine. Achieving a high cooling efficiency based on the rate of heat transfer is a significant design consideration in order to minimize the volume of coolant air diverted from the compressor for cooling.

The trailing edge of a turbine airfoil is made relatively thin for aerodynamic efficiency. The relatively narrow trailing edge portion of a gas turbine airfoil may include, for example, up to about one third of the total airfoil external surface area. Turbine airfoils are often manufactured by a casting process involving a casting core, typically made of a ceramic material. The core material represents the hollow flow passages inside turbine airfoil. It is beneficial for the casting core to have sufficient structural strength to survive through the handling during the casting process. To this end, the coolant exit apertures at the airfoil trailing edge may be designed to have larger dimensions near the root and the tip of the airfoil, to form a stronger picture frame like configuration, which may result in higher coolant flow near the airfoil root and tip than desired.

It is desirable to have an improvement to achieve not only a strong casting core but also a limitation in the coolant flow.

SUMMARY

Briefly, aspects of the present invention provide a turbine airfoil with trailing edge framing features.

According a first aspect of the present invention, a turbine airfoil is provided. The turbine airfoil comprises an outer wall delimiting an airfoil interior, the outer wall extending span-wise along a radial direction of a turbine engine and being formed of a pressure sidewall and a suction sidewall joined at a leading edge and a trailing edge. A trailing edge coolant cavity is located in the airfoil interior between the pressure sidewall and the suction sidewall. The trailing edge coolant cavity is positioned adjacent to the trailing edge and in fluid communication with a plurality of coolant exit slots positioned along the trailing edge. At least one framing passage is formed at a span-wise end of the trailing edge coolant cavity. The turbine airfoil further comprises framing features located in the framing passage. The framing features are configured as ribs protruding from the pressure sidewall and/or the suction sidewall. The ribs extend partially between the pressure sidewall and the suction sidewall.

According a second aspect of the present invention, a casting core for forming a turbine airfoil is provided. The casting core comprises a core element forming a trailing edge coolant cavity of the turbine airfoil. The core element comprises a core pressure side and a core suction side extending in a span-wise direction, and further extending chord-wise toward a core trailing edge. At a span-wise end of the core element, a plurality of indentations are provided at the core suction side and/or the core pressure side. The indentations form framing features in the trailing edge coolant cavity of the turbine airfoil.

BRIEF DESCRIPTION OF THE DRAWINGS

The invention is shown in more detail by help of figures. The figures show preferred configurations and do not limit the scope of the invention.

DETAILED DESCRIPTION

Figure 1:
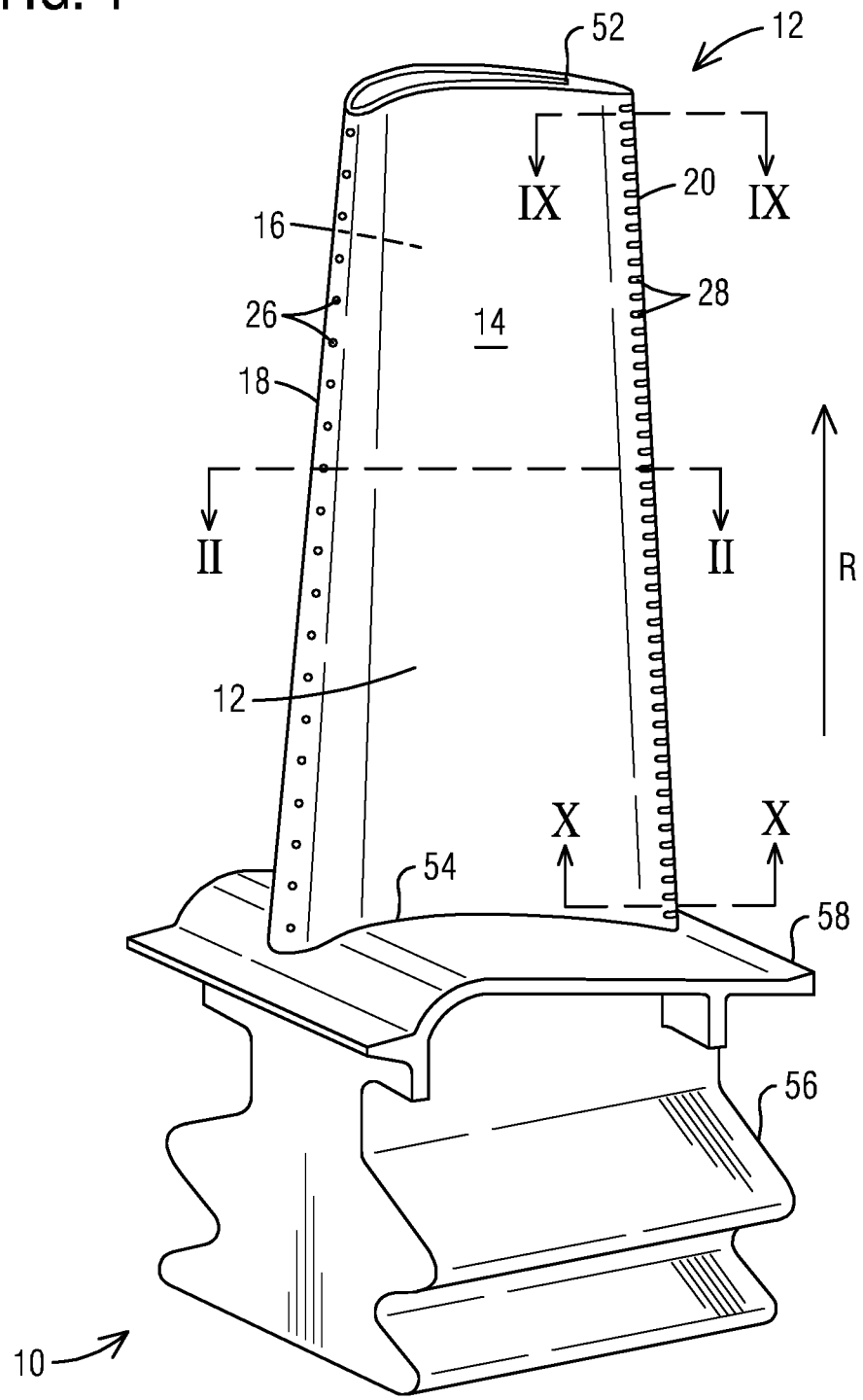
FIG. 1 is a perspective view of a turbine airfoil featuring embodiments of the present invention.

In the following detailed description of the preferred embodiments, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

In the drawings, the direction X denotes an axial direction parallel to an axis of the turbine engine, while the directions R and T respectively denote a radial direction and a tangential (or circumferential) direction with respect to said axis of the turbine engine.

Referring now to FIG. 1, a turbine airfoil 10 is illustrated according to one embodiment. As illustrated, the airfoil 10 is a turbine blade for a gas turbine engine. It should however be noted that aspects of the invention could additionally be incorporated into stationary vanes in a gas turbine engine. The airfoil 10 may include an outer wall 12 adapted for use, for example, in a high pressure stage of an axial flow gas turbine engine. The outer wall 12 delimits a hollow interior 11 (see FIG. 2). The outer wall 12 extends span-wise along a radial direction R of the turbine engine and includes a generally concave shaped pressure sidewall 14 and a generally convex shaped suction sidewall 16. The pressure sidewall 14 and the suction sidewall 16 are joined at a leading edge 18 and at a trailing edge 20. The outer wall 12 may be coupled to a root 56 at a platform 58. The root 56 may couple the turbine airfoil 10 to a disc (not shown) of the turbine engine. The outer wall 12 is delimited in the radial direction by a radially outer airfoil end face (airfoil tip cap) 52 and a radially inner airfoil end face 54 coupled to the platform 58. In other embodiments, the airfoil 10 may be a stationary turbine vane with a radially inner end face coupled to the inner diameter of the turbine gas path section of the turbine engine and a radially outer end face coupled to the outer diameter of the turbine gas path section of the turbine engine.

Figure 2:
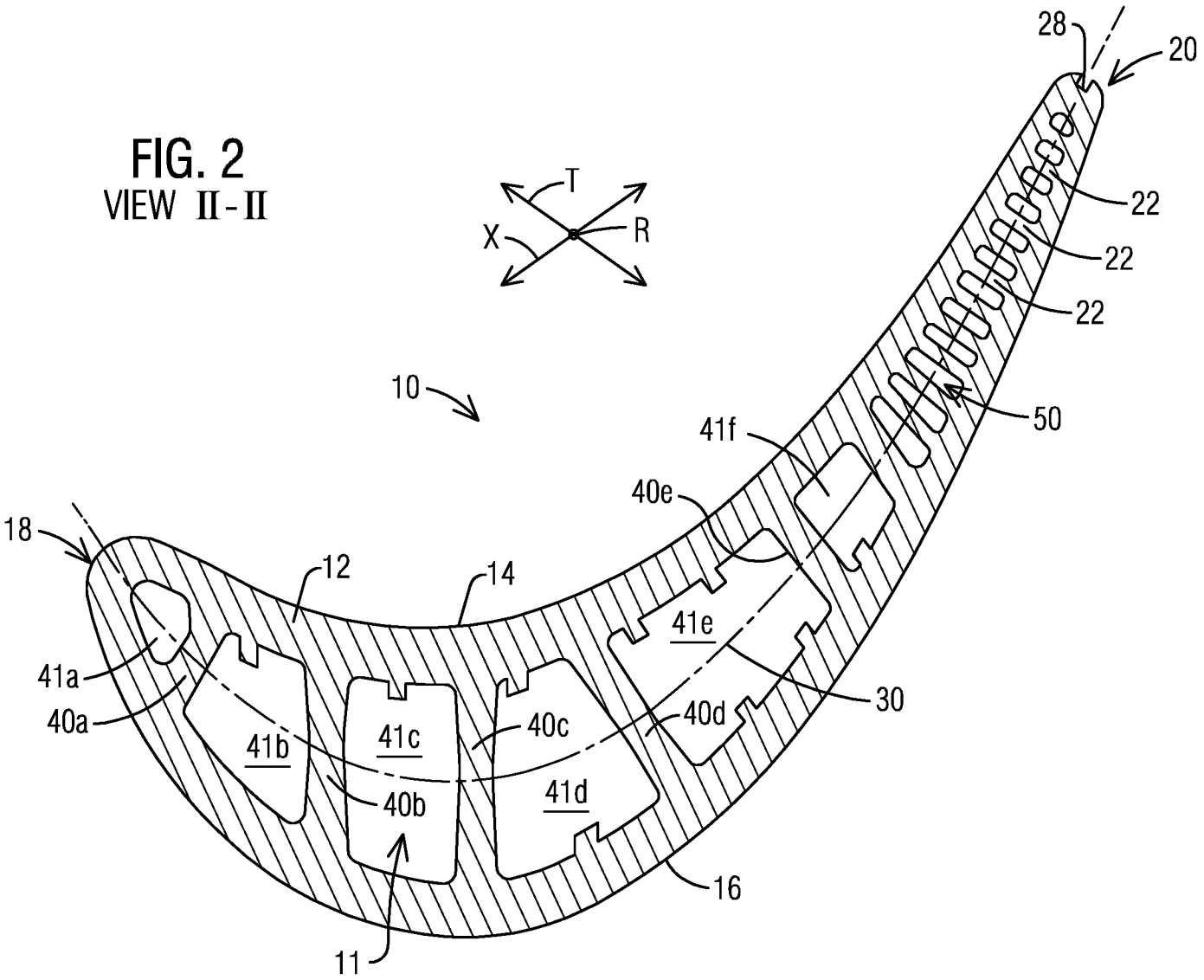
FIG. 2 is a mid-span cross-sectional view through the turbine airfoil along the section II-II of FIG. 1 according to one embodiment of the invention.

Referring to FIG. 2, a chordal axis 30 may be defined extending centrally between the pressure sidewall 14 and the suction sidewall 16. In this description, the relative term "forward" refers to a direction along the chordal axis 30 toward the leading edge 18, while the relative term "aft" refers to a direction along the chordal axis 30 toward the trailing edge 20. As shown, internal passages and cooling circuits are formed by radial coolant cavities 41*a-f* that are created by internal partition walls or ribs 40*a-e* which connect the pressure and suction sidewalls 14 and 16 along a radial extent. In the present example, coolant may enter one or more of the radial cavities 41*a-f* via openings provided in the root of the blade 10, from which the coolant may traverse into adjacent radial coolant cavities, for example, via one or more serpentine cooling circuits. Examples of such cooling schemes are known in the art and will not be further discussed herein. Having traversed the radial coolant cavities, the coolant may be discharged from the airfoil 10 into the hot gas path, for example via exhaust orifices 26, 28 located along the leading edge 18 and the trailing edge 20 respectively. Although not shown in the drawings, exhaust orifices may be provided at multiple locations, including anywhere on the pressure sidewall 16, suction sidewall 18, and the airfoil tip 52.

The aft-most radial coolant cavity 41*f*, which is adjacent to the trailing edge 20, is referred to herein as the trailing edge coolant cavity 41*f*. Upon reaching the trailing edge coolant cavity 41*f*, the coolant may traverse axially through an internal arrangement 50 of trailing edge cooling features, located in the trailing edge coolant cavity 41*e*, before leaving the airfoil 10 via coolant exit slots 28 arranged along the trailing edge 20. Conventional trailing edge cooling features included a series of impingement plates, typically two or three in number, arranged next to each other along the chordal axis. However, this arrangement provides that the coolant travels only a short distance before exiting the airfoil at the trailing edge. It may be desirable to have a longer coolant flow path along the trailing edge portion to have more surface area for transfer of heat, to improve cooling efficiency and reduce coolant flow requirement.

Figure 3:
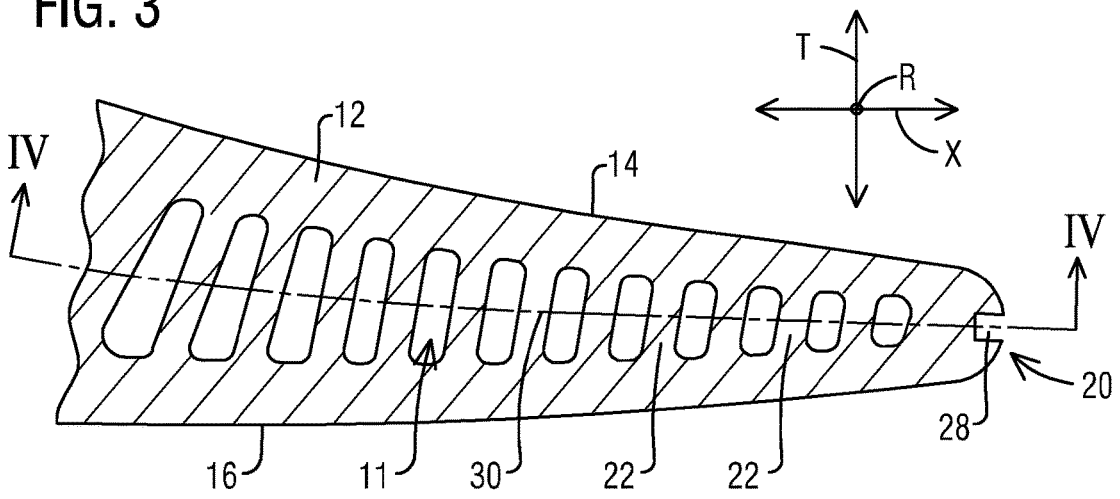
FIG. 3 is an enlarged mid-span cross-sectional view showing the trailing edge portion of the turbine airfoil.
Figure 4:
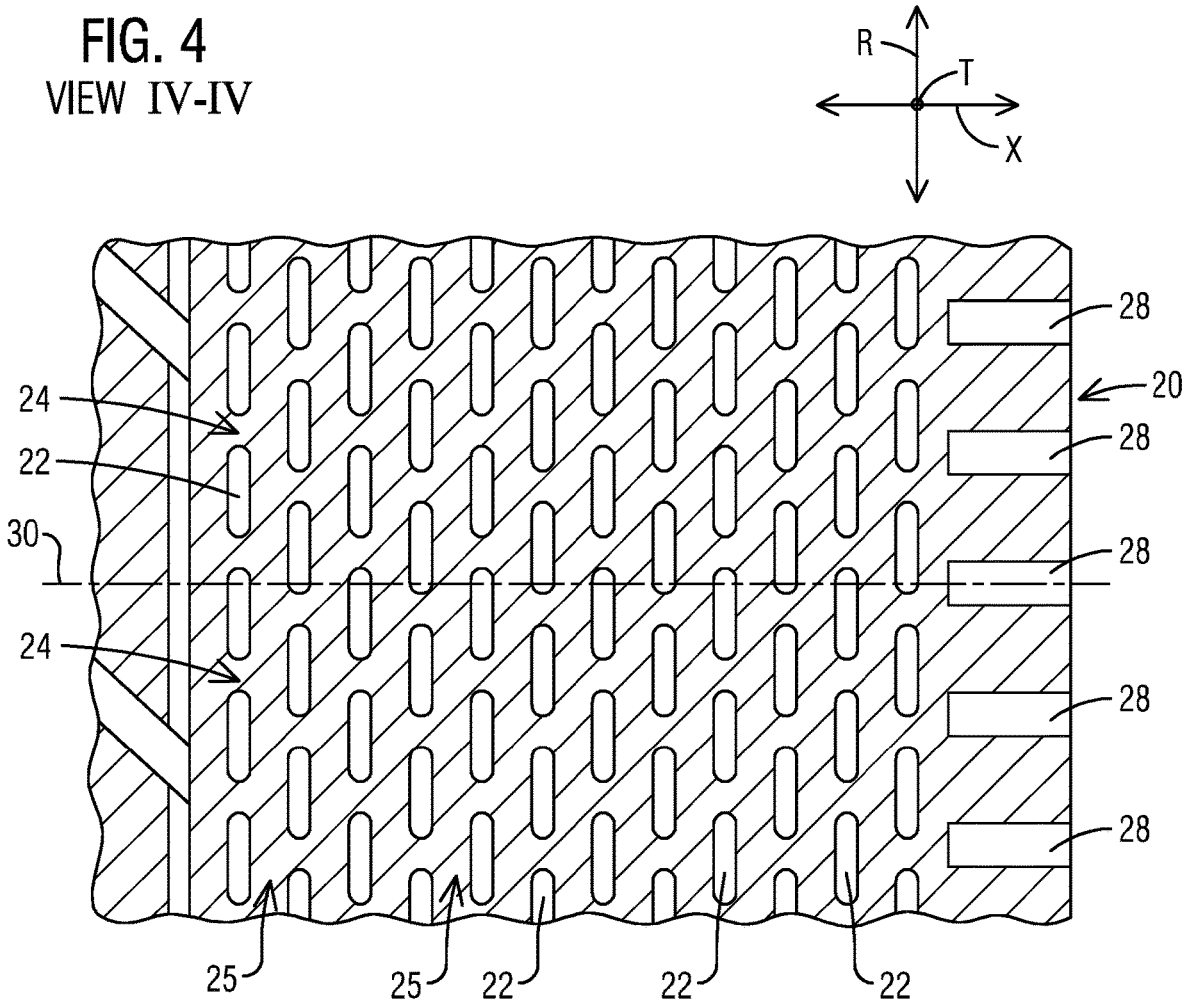
FIG. 4 is a cross-sectional view along the section IV-IV of FIG. 3.

The present embodiment, as particularly illustrated in FIG. 3-4, provides an improved arrangement of trailing edge cooling features. In this case, the impingement plates are replaced by an array of cooling features embodied as pins 22. Each feature or pin 22 extends all the way from the pressure sidewall 14 to the suction sidewall 16 as shown in FIG. 3. The features 22 are arranged in radial rows as shown in FIG. 4. The features 22 in each row are interspaced to define axial coolant passages 24, with each coolant passage 24 extending all the way from the pressure sidewall 14 to the suction sidewall 16. The rows, in this case fourteen in number, are spaced along the chordal axis 30 to define radial coolant passages 25.

The features 22 in adjacent rows are staggered in the radial direction. The axial coolant passages 24 of the array are fluidically interconnected via the radial flow passages 25, to lead a pressurized coolant in the trailing edge coolant cavity 41*f* toward the coolant exit slots 28 at the trailing edge 20 via a serial impingement scheme. In particular, the pressurized coolant flowing generally forward-to-aft impinges serially on to the rows of features 22, leading to a transfer of heat to the coolant accompanied by a drop in pressure of the coolant. Heat may be transferred from the outer wall 12 to the coolant by way of convection and/or impingement cooling, usually a combination of both.

In the illustrated embodiment, each feature 22 is elongated along the radial direction. That is to say, each feature 22 has a length in the radial direction which is greater than a width in the chord-wise direction. A higher aspect ratio provides a longer flow path for the coolant in the passages 25, leading to increased cooling surface area and thereby higher convective heat transfer. In relation to the double or triple impingement plates, the described arrangement provides a longer flow path for the coolant and has been shown to increase both heat transfer and pressure drop to restrict the coolant flow rate. Such an arrangement may thus be suitable in advanced turbine blade applications which require smaller amounts of cooling air.

The exemplary turbine airfoil 10 may be manufactured by a casting process involving a casting core, typically made of a ceramic material. The core material represents the hollow coolant flow passages inside turbine airfoil 10. It is beneficial for the casting core to have sufficient structural strength to survive through the handling during the casting process. To this end, the coolant exit slots 28 at the trailing edge 20 may be designed to have larger dimensions at the span-wise ends of the airfoil, i.e., adjacent to the root and the tip of the airfoil 10, to form a stronger picture frame like configuration. However, such a configuration may result in higher coolant flow near the airfoil root and tip than desired. Embodiments of the present invention provide an improvement to achieve not only a strong casting core but also a limitation in the coolant flow.

Figure 5A:
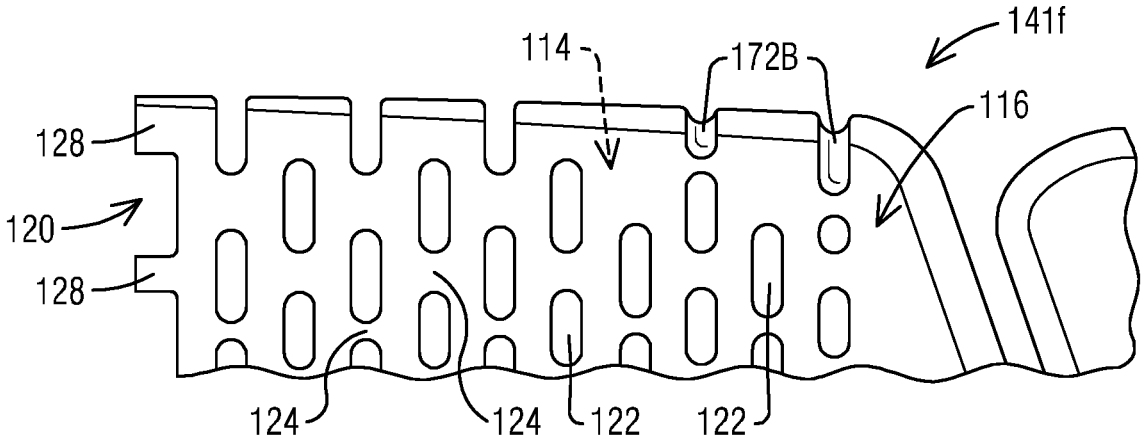
FIGS. 5A and 5B illustrate a span-wise configuration of a portion of a casting core looking in a direction from the core suction side to the core pressure side.
Figure 5B:
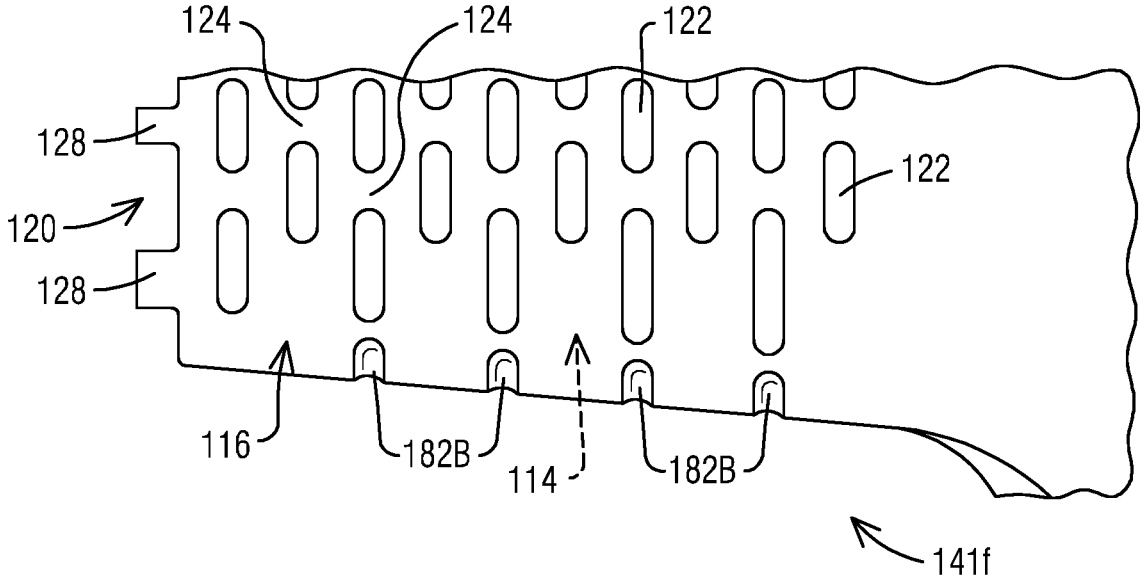
Figure 6A:
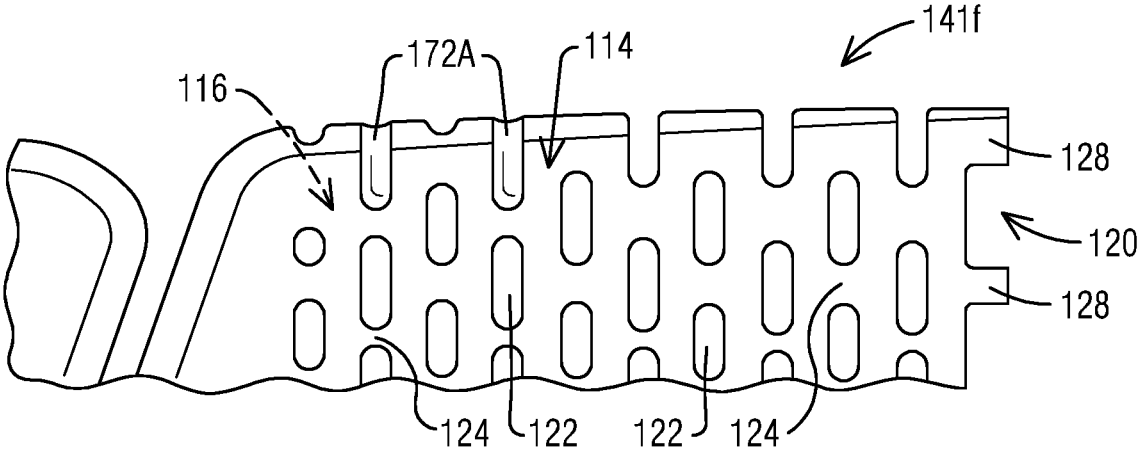
FIGS. 6A and 6B illustrates a span-wise configuration of a portion of the casting core looking in a direction from the core pressure side to the core suction side.
Figure 6B:
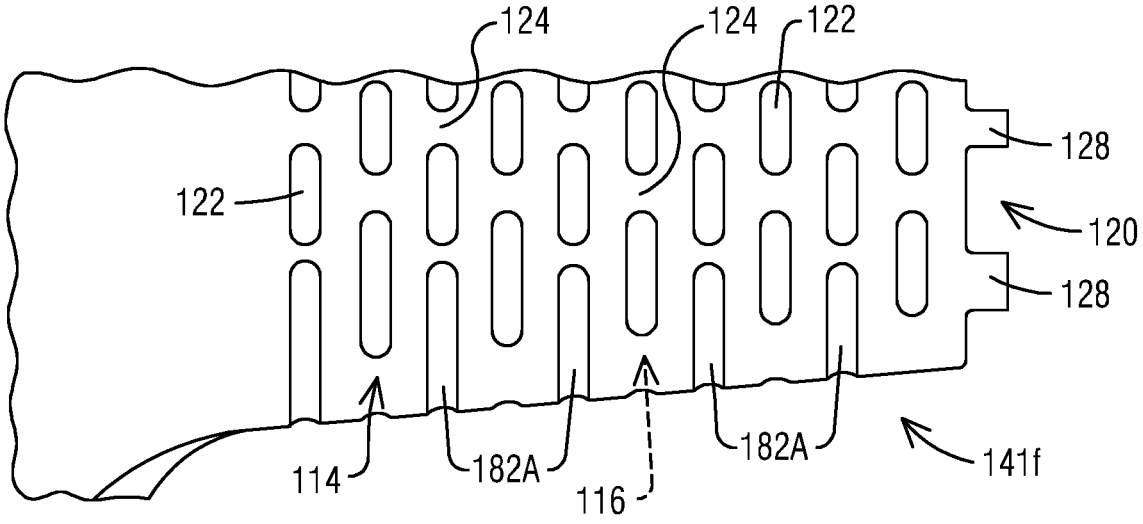
Figure 7:
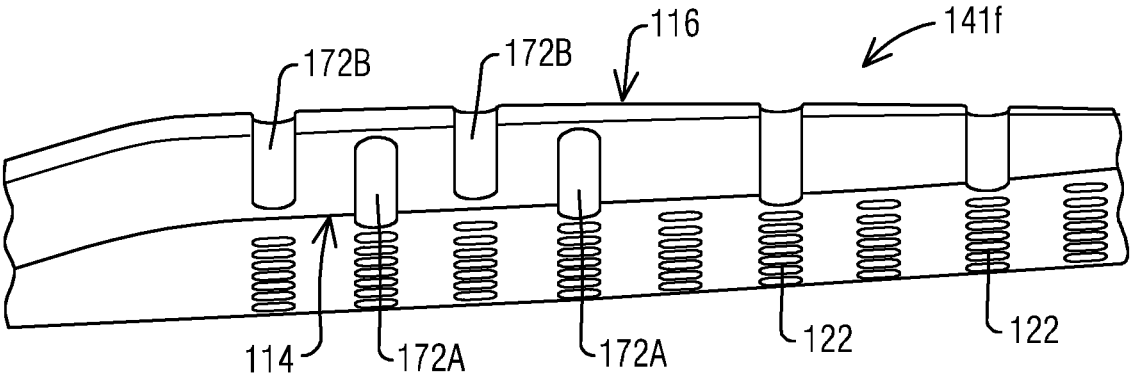
FIG. 7 is a top view of the casting core, looking radially inward.
Figure 8:
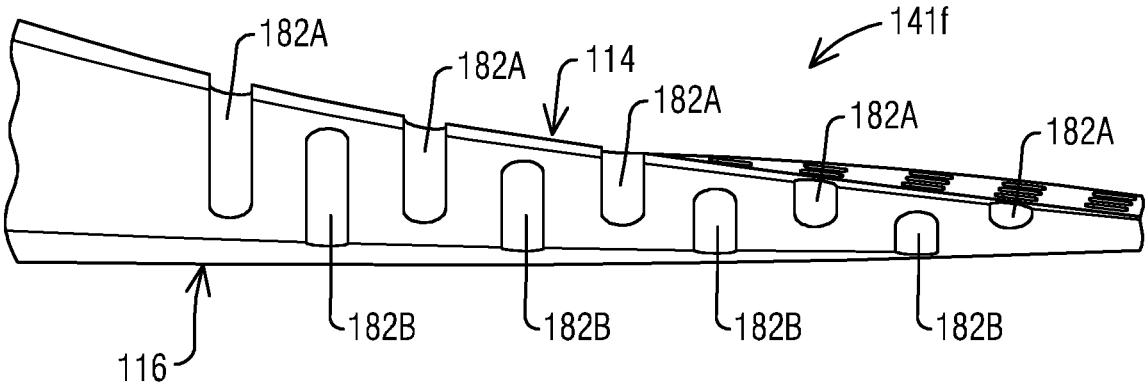
FIG. 8 is a bottom view of the casting core, looking radially outward.

FIGS. 5A-B, 6A-B and 7-8 illustrate portion of an exemplary casting core for manufacturing the inventive turbine airfoil 10. The illustrated core element 141*f* represents the trailing edge coolant cavity 41*f* of the turbine airfoil 10. The core element 141*f* has a core pressure side 114 and a core suction side 116 extending in a span-wise direction, and further extending chord-wise toward a core trailing edge 120. FIGS. 5A and 5B illustrate a views looking from the core suction side 116, with FIG. 5A illustrating a first span-wise end portion which is adjacent to the radially outer airfoil end face 52 (airfoil tip cap), and FIG. 5B illustrating a second span-wise end portion which is adjacent to the radially inner airfoil end face 54 coupled to the platform 58. FIG. 6A-B illustrate views looking from the core pressure side 114, with FIG. 6A illustrating a first span-wise end portion which is adjacent to the radially outer airfoil end face 52 (airfoil tip cap), and FIG. 6B illustrating a second span-wise end portion which is adjacent to the radially inner airfoil end face 54 coupled to the platform 58. As shown, the core element 141*f* comprises an array of perforations 122 there-through, located between span-wise ends of the core element 141*f*. Each perforation 122 extends all the way from the core pressure side 114 to the core suction side 116. The perforations 122 form the cooling features the 22 in the trailing edge coolant cavity 41*f* (see FIG. 4). Each perforation 122 is correspondingly elongated in the radial or span-wise direction. The array comprises multiple radial rows of said perforations 122 with the perforations 122 in each row being interspaced radially by interstitial core elements 124 that form the coolant passages 24 in the turbine airfoil 10. The core elements 128 form the trailing edge coolant exit slots 28 of the turbine airfoil 10.

As shown in FIG. 5A-B and FIG. 6A-B, the array of perforations 122 is located between the span-wise ends of the core element 141*f*, but does not extend all the way up to the span-wise ends thereof. As per embodiments of the present invention, at the span-wise ends of the core element 141*f*, indentations are provided on the core pressure side 114 and/or the core suction side 116. In the non-limiting example as illustrated herein, at the radially outer span-wise end, indentations are provided at a chord-wise upstream location of the core element 141*f*, which is generally thicker. At the relatively narrow chord-wise downstream location, perforations may formed through the core element 141*f* along the radially outer span-wise end thereof. At the radially inner span-wise end, perforations are eliminated altogether. In the illustrated embodiment, chord-wise spaced indentations 172A and 182A are provided on the first and second span-wise ends of the core pressure side 114 respectively (FIG. 6A-B) and chord-wise spaced indentations 172B and 182B are provided on the first and second span-wise ends of the core suction side 116 respectively (FIG. 5A-B).

Figure 9:
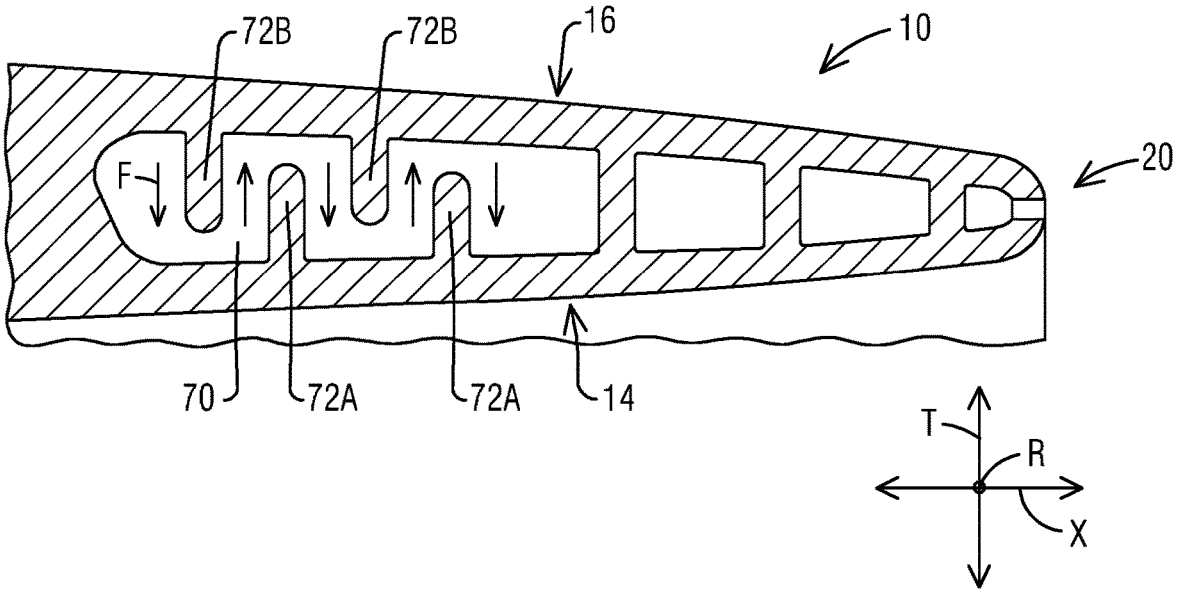
FIG. 9 is a cross-sectional view illustrating framing features near a radially outer span-wise end of the airfoil, along the section IX-IX of FIG. 1.
Figure 10:
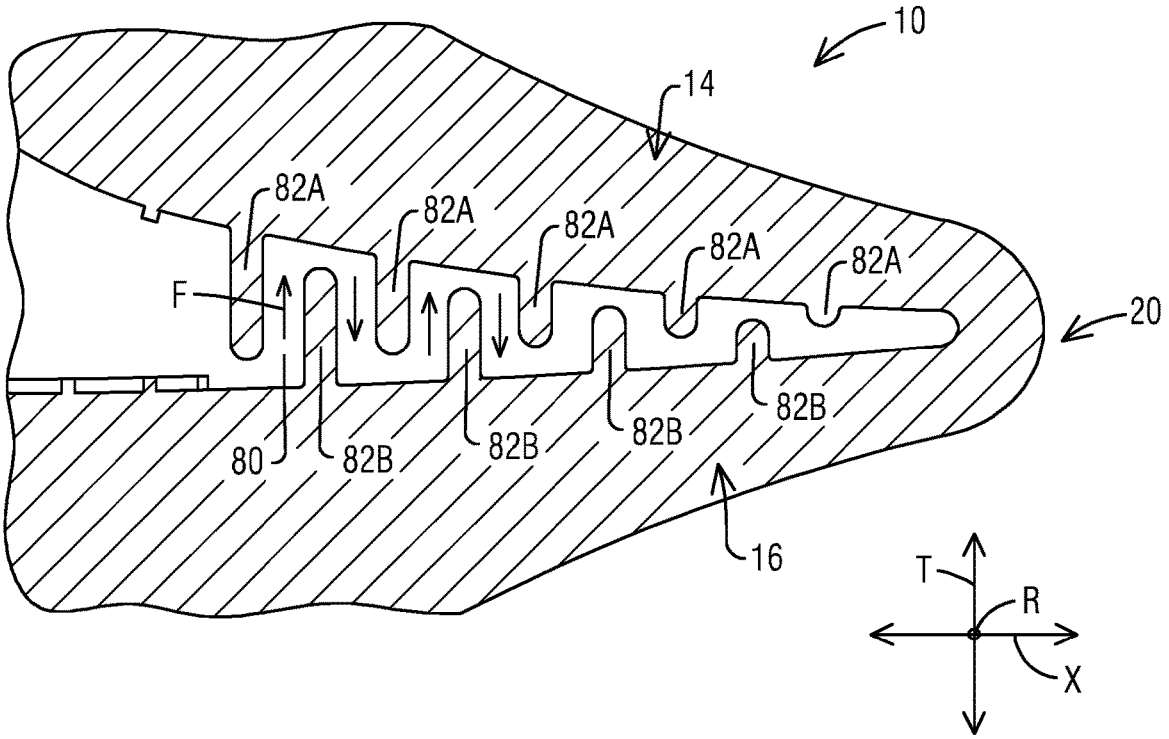
FIG. 10 is a cross-sectional view illustrating framing features near a radially inner span-wise end of the airfoil, along the section X-X of FIG. 1.

As shown in FIGS. 9 and 10, the indentations 172A-B and 182A-B (shown in FIG. 5A-B and FIG. 6A-B) form framing features 72A-B, 82A-B in a respective framing passage 70, 80 in the trailing edge coolant cavity 41*f* of the turbine airfoil 10. The framing passages 70 and 80 are located at first and second span-wise ends respectively of the trailing edge coolant cavity 41*f* In particular, the respective framing passage 70, 80 is located between the cooling features 22 and a respective airfoil radial end face 52, 54. The framing features 72A-B, 82A-B are configured as ribs. As can be seen, the ribs 72A, 82A protrude from the pressure sidewall 14 of the airfoil 10, and the ribs 72B, 82B protrude from the suction sidewall 16 of the airfoil 10. Each of the ribs 72A-B, 82A-B extends only partially between the pressure sidewall 14 and the suction sidewall 16.

The indentations 172A-B, 182A-B maintain strength of the ceramic core at the root and the tip, as opposed to complete perforations through the core pressure and suction sides. In the illustrated embodiment, as shown in the radial top view in FIG. 7, the indentations 172A on the core pressure side 114 and the indentations 172B on the core suction side 116 are alternately positioned along the chord-wise direction. Like-wise, as shown in the radial bottom view in FIG. 8, the indentations 182A on the core pressure side 114 and the indentations 182B on the core suction side 116 are alternately positioned along the chord-wise direction.

The resultant framing features are illustrated in FIGS. 9 and 10. Referring to FIG. 9, the ribs 72A on the pressure sidewall 14 and the ribs 72B on the suction sidewall 16 are alternately positioned in the chord-wise direction to define a zigzag flow path F of the coolant flowing in the framing passage 70 toward the coolant exit slots 28. Referring to FIG. 10, the ribs 82A on the pressure sidewall 14 and the ribs 82B on the suction sidewall 16 are alternately positioned in the chord-wise direction to define a zigzag flow path F of the coolant flowing in the framing passage 80 toward the coolant exit slots 28. As illustrated, each zigzag flow path F is configured as a mini-serpentine path where the coolant flow direction alternates between the pressure sidewall 14 and the suction sidewall 16 while generally chord-wise in the framing passage 70, 80 toward the trailing edge coolant exit slots 28. The zigzag flow path F provides a highly tortuous flow passage for the coolant to restrict coolant flow, particularly at the span-wise ends (near the root and the tip of the airfoil) where the trailing edge coolant exit slots 28 have a larger dimension to maintain core stability. The zigzag passages provide a high pressure drop and high heat transfer for very limited coolant flow rate while maintaining a strong ceramic core.

In alternate embodiments, features of the present invention may be employed for trailing edge cooling features which comprise a plurality of impingement plates with impingement orifices (as opposed to an array of pins as illustrated above), in which the impingement plates are arranged in series in a chord-wise direction.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine airfoil comprising:

an outer wall delimiting an airfoil interior, the outer wall extending span-wise along a radial direction of a turbine engine and being formed of a pressure sidewall and a suction sidewall joined at a leading edge and at a trailing edge, a trailing edge coolant cavity located in the airfoil interior between the pressure sidewall and the suction sidewall, the trailing edge coolant cavity being positioned adjacent to the trailing edge and in fluid communication with a plurality of coolant exit slots positioned along the trailing edge, wherein a radially outer span-wise end framing passage is formed at a radially outer span-wise end of the trailing edge coolant cavity and a radially inner span-wise end framing passage is formed at a radially inner span-wise end of the trailing edge coolant cavity, and framing features located in the radially outer span-wise end framing passage and in the radially inner span-wise end framing passage, the framing features configured as ribs protruding from the pressure sidewall and/or the suction sidewall, the ribs extending partially between the pressure sidewall and the suction sidewall, a plurality of cooling features located in the trailing edge coolant cavity that are disposed in a flow path of the coolant flowing toward the coolant exit slots, the cooling features being located between the radially outer span-wise end of the trailing edge coolant cavity and the radially inner span-wise end of the trailing edge coolant cavity, wherein the cooling features comprise an array of pins, the array of pins comprising multiple chord-wise spaced apart radial rows of said pins, wherein the ribs are arranged chord-wise spaced apart on the pressure sidewall and/or the suction sidewall, and wherein each rib is aligned with a respective row of said pins in the radial direction.

2. The turbine airfoil according to claim 1, wherein the framing passage extends chord-wise toward the trailing edge.

3. The turbine airfoil according to claim 2, wherein said ribs are formed on the pressure sidewall and on the suction sidewall, and wherein the ribs on the pressure sidewall and the ribs on the suction sidewall are alternately positioned in a chord-wise direction to define a zigzag flow path of the coolant flowing in the framing passage toward the exit slots.

4. The turbine airfoil according to claim 1, wherein each pin extends from the pressure sidewall to the suction sidewall, the pins in each row being interspaced radially to define coolant passages therebetween.

5. The turbine airfoil according to claim 4, wherein each pin is elongated in the radial direction.

6. A casting core for forming a turbine airfoil, comprising:

a core element forming a trailing edge coolant cavity of the turbine airfoil, the core element comprising a core pressure side and a core suction side extending in a span-wise direction, and further extending chord-wise toward a core trailing edge, wherein at a span-wise end of the core element, a plurality of indentations are provided at the core pressure side and/or the core suction side, the plurality of indentations are provided at a radially outer span-wise end of the core element and at a radially inner span-wise end of the core element, the indentations forming framing features in a radially outer span-wise end framing passage formed at the radially outer span-wise end of the trailing edge coolant cavity and in a radially inner span-wise end framing passage formed at the radially inner span-wise end of the trailing edge coolant cavity of the turbine airfoil, an array of perforations through the core element located between the radially outer span-wise end of the core element and the radially inner span-wise end of the core element, the perforations forming cooling features in the trailing edge coolant cavity of the turbine airfoil, wherein the array of perforations comprises multiple radial rows of said perforations spaced apart in a chord-wise direction, wherein the indentations on the core pressure side and/or the core suction side are spaced apart in the chord-wise direction, and wherein each indentation is aligned with a respective row of said perforations in the radial direction.

7. The casting core according to claim 6, wherein said indentations are formed on the core pressure side and on the core suction side, and wherein the indentations on the care pressure side and the indentations on the core suction side are alternately positioned in the chord-wise direction.

8. The casting core according to claim 6, wherein each perforation extends from the core pressure side to the core suction side, the perforations in each row being interspaced radially by interstitial core elements that form coolant passages in the turbine airfoil.

9. The casting core according to claim 6, wherein each perforation is elongated in the radial direction.

* * * * *